US005367965A

United States Patent [19]

Earnhardt

[11] Patent Number: 5,367,965

[45] Date of Patent: Nov. 29, 1994

[54] FORMING A RUG FROM A SEWN TUBULAR BRAID

[75] Inventor: Kenneth M. Earnhardt, Seneca, S.C.

[73] Assignee: Homemaker Industries, Inc., New York, N.Y.

[21] Appl. No.: 966,312

[22] Filed: Oct. 26, 1992

[51] Int. Cl.[5] ..... D05B 03/24; D05B 29/00

[52] U.S. Cl. ..... 112/9; 112/63; 112/235; 112/262.2

[58] Field of Search ..... 112/9, 262.1, 63, 104, 112/121.2, 138, 139, 235, 262.2, 147, 412, 415, 418, 441, 7, 121.27, 121.18; 428/37, 102, 74

[56] References Cited

U.S. PATENT DOCUMENTS

| | | | |
|---|---|---|---|
| 978,481 | 12/1910 | Pelham | 112/63 |
| 1,381,832 | 6/1921 | Heinenheim | 112/9 X |
| 1,431,898 | 10/1922 | Rissmann | 112/63 |
| 1,455,384 | 5/1923 | Bates | 112/63 |
| 1,464,879 | 8/1923 | Mathis | 112/63 |
| 1,481,001 | 1/1924 | Fenton | 112/63 |
| 1,923,551 | 8/1933 | Murphy | 428/37 |
| 2,053,744 | 9/1936 | Sailer | 112/2 |
| 2,107,837 | 2/1938 | Robbins | 112/63 |
| 2,126,254 | 8/1938 | Gowell | 112/9 X |
| 2,294,074 | 8/1942 | Christensen | 112/63 |
| 2,314,202 | 3/1943 | Ewer et al. | 112/63 |
| 2,320,271 | 5/1943 | Everitt | 112/23 |
| 2,415,824 | 2/1947 | Katz et al. | 112/63 |
| 2,623,484 | 12/1952 | Zeier | 112/63 |
| 3,054,367 | 9/1962 | Loiselle | 112/152 |
| 3,098,281 | 7/1963 | Flitterman | 428/37 |
| 3,195,486 | 7/1965 | Egert | 112/139 |
| 3,481,245 | 12/1969 | Kamitani | 112/412 X |
| 3,505,154 | 4/1970 | Logrippo | 428/37 |
| 3,875,877 | 4/1975 | Fox | 112/63 |
| 4,802,426 | 2/1989 | Hinshaw | 112/262.1 |
| 5,065,543 | 11/1991 | Brook | 47/25 |

*Primary Examiner*—Clifford D. Crowder
*Assistant Examiner*—Ismael Izaguirre
*Attorney, Agent, or Firm*—Darby & Darby

[57] ABSTRACT

An apparatus for sewing a tubular braid with an internal seam and simultaneously filling it with the required filler. A strip of covering fabric is fed to a sewing area from a first direction and folded over so that its lateral edges meet in the sewing area of a sewing machine. Immediately after sewing, the tube is inwardly inverted and pulled toward the direction from which the fabric came, thus being pulled through the folded but unsewn portion of the strip. A core filler material is fed from the opposite direction into the interior of the inverted tube as it is inverted to form the finished braid. The finished braid may then be coiled into a rug shape. Adjacent sections of the braid are then sewn together using dual stitches on the upper and lower surfaces of the rug, to ensure that the surfaces remain flat.

12 Claims, 6 Drawing Sheets

FORMING A RUG FROM A SEWN TUBULAR BRAID

FIELD OF THE INVENTION

This invention relates generally to apparatus for producing household articles. More specifically, the invention relates to an apparatus and method for producing a rug formed from a tubular braid.

BACKGROUND OF THE INVENTION

Throw rugs that are formed with a circular or dromic (race course-like) pattern have been known in the art for many years. Their relative ease of manufacture, as well as their familiar appearance, has made them commonplace in modern households.

However, their construction leads to serious deficiencies in durability, comfort, feel, and appearance. In general, these rugs have been produced by folding a strip of fabric around a filler that has been laid along the strip's longitudinal axis. When the two lateral edges of the strip meet, they are sewn together, leaving a small exposed seam. After sewing a significant portion of a strip, a filled tube is produced that can be coiled into the shape of the desired rug. The adjacent tubes are then sewn together with a single stitch at the point of tangential contact between the tubes.

The end product of this method of production is a rug that has the look and feel of a series of adjacent tubes. The individual tubes generally retain their tubular shape, leaving deep valleys between adjacent tubes. These valleys produce spaces between tubes at the upper surface of the rugs that permit easy insertion of objects, such as heels of shoes, that eventually cause adjacent tubes to spread apart, giving the rug a ragged look. The peaks and valleys also make the rug less comfortable for any person that might choose to lie or step on it.

An alternative known method for producing the tubes is to sew a long tube without a filler inside it. Once completed, the entire tube can be manually inverted while a filler is manually inserted into the tube. However, this is a highly labor-intensive operation that adds a significant cost to the rug production, with only a minimal increase in quality.

SUMMARY OF THE INVENTION

In view of the deficiencies in known rugs, it is an object of the invention to provide an apparatus for making a tubular braid for a rug that is filled as it is sewn.

It is a further object to provide an apparatus for making a rug from the tubular braid that sews adjacent tubes with an upper and lower cross stitch so that the tube will assume generally planar, continuous surfaces on the upper and lower surfaces of the rug.

It is another object to provide a method for forming a tubular braid and for forming the braid into a rug.

In view of the foregoing objects, an apparatus is provided for sewing a tubular braid with an internal seam and simultaneously filling it with the required filler. A strip of covering fabric is fed to a sewing area from a first direction and folded over so that its lateral edges meet in the sewing area of a sewing machine. Immediately after sewing, the tube is turned inside-out or inwardly inverted and pulled in the reverse direction, thus being pulled through the folded but unsewn portion of the strip. A core filler material is fed from the opposite direction into the interior of the tube as it is turned inside-out to form the finished braid.

The finished braid is then coiled into a rug shape of expanding concentric elements. Adjacent sections of the braid are then sewn together using dual stitches on the upper and lower surfaces of the rug, to ensure that the surfaces remain flat and substantially continuous.

BRIEF DESCRIPTION OF THE DRAWINGS

The foregoing objects and advantages of the invention will become apparent to those skilled in the art upon reading the detailed description of the preferred embodiments in conjunction with a review of the appended drawings, in which.

DETAILED DESCRIPTION OF THE PREFERRED EMBODIMENTS

Figure 1:
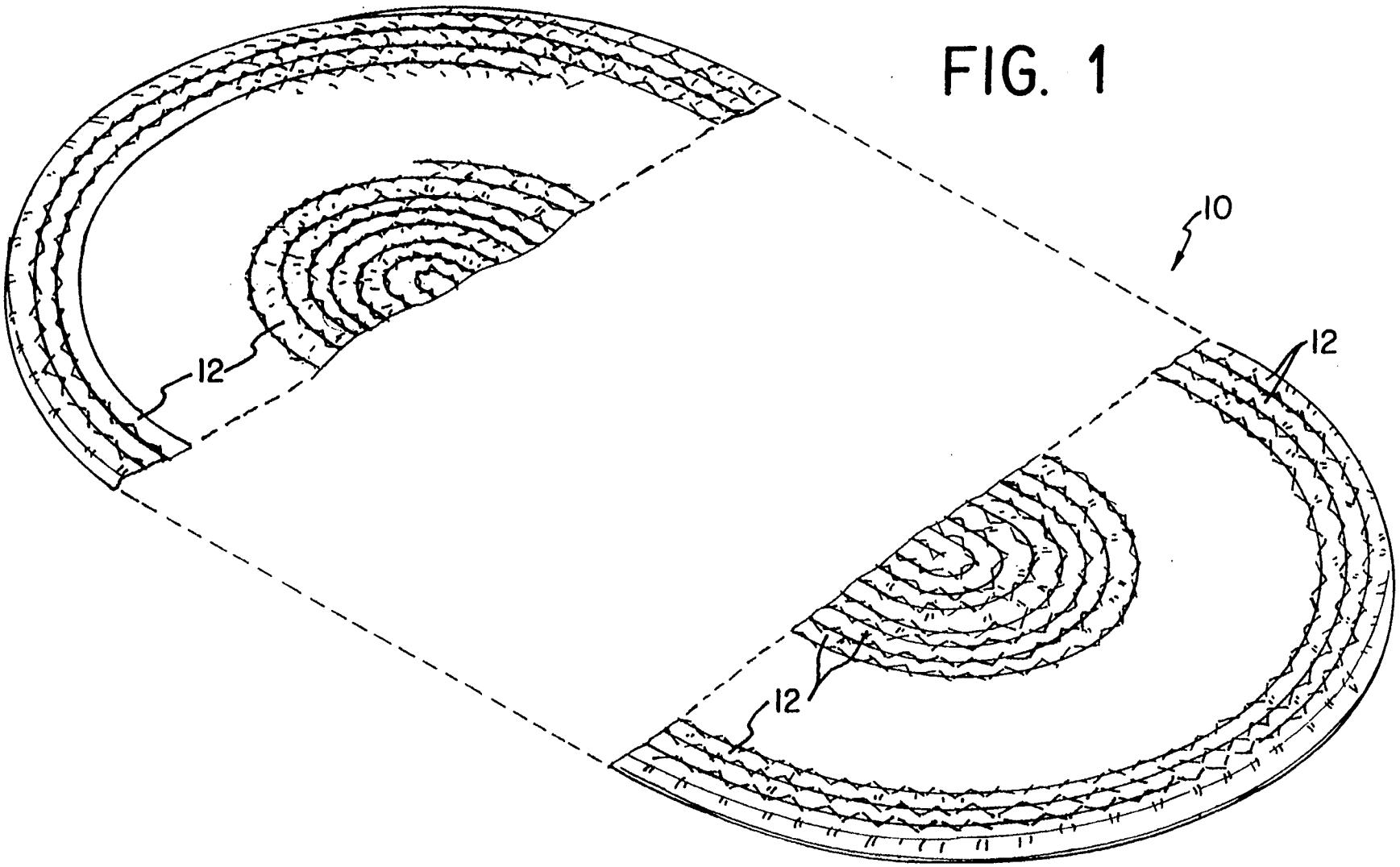
FIG. 1 is a perspective view of a finished rug according to the invention.

FIG. 1 shows a rug 10 produced according to the present invention in its finished form. The rug 10 comprises a tubular braid 12 stitched into a coiled arrangement. The stitching, discussed in greater detail below, attaches adjacent sections of the braid at both the top and bottom surfaces of the rug 10.

Figure 2:
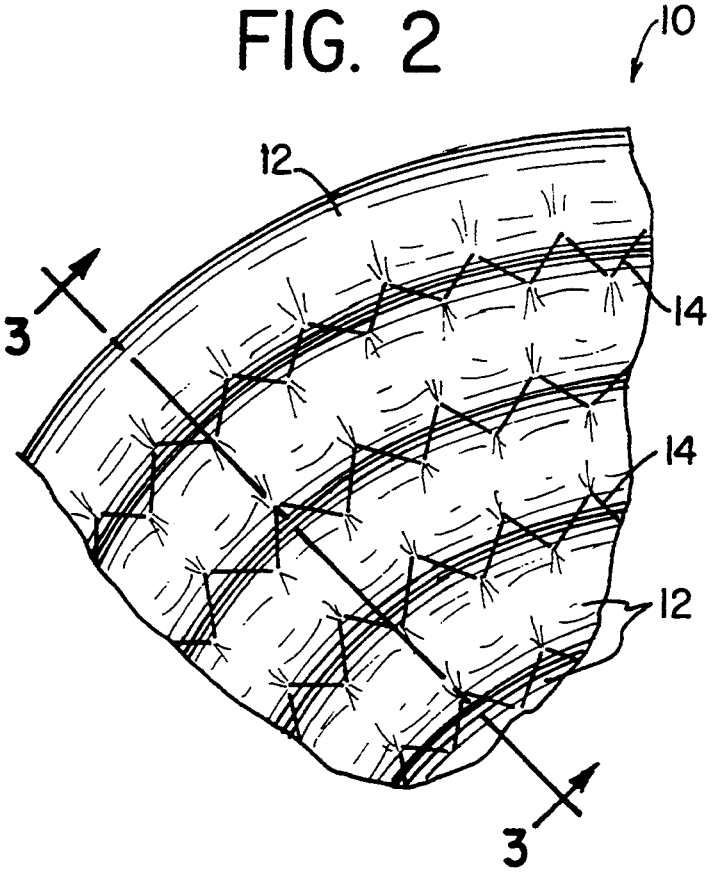
FIG. 2 is a detail top view of a portion of the rug shown in FIG. 1.
Figure 3:
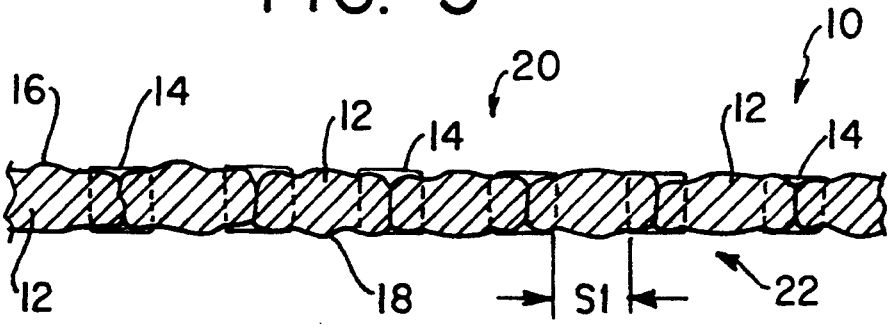
FIG. 3 is a detail cross-sectional view taken along the line 3—3 of FIG. 2.

The preferred stitching arrangement is shown in FIGS. 2 and 3. A tight zig-zag stitch 14 is used to bring the upper surfaces 16 of adjacent sections of the tubular braid 12 into close abutment to form a substantially continuous surface. As seen in FIG. 3, the stitches 14 penetrate through the braid 12 and also bring the bottom surfaces 18 of the same sections of braid 12 together. The effect of this tight stitching is to distort the original circular cross-section of the braid to a more rectangular shape having distinct upper and lower surfaces 16, 18. When these surfaces are adjacent to each other, the overall effect is to produce a rug 10 with flatter, substantially continuous top and bottom surfaces 20, 22, as compared to the bumps and valleys found on conventional rugs of this type. A sewing machine foot for stitching the tubular braid in this fashion is described fully below.

To achieve the flat upper and lower surfaces 16, 18, it is preferred that the stitches 14 penetrate the braids away from the point of tangential contact between adjacent braids. As seen in FIG. 3, the distance S1 between stitches 14 in a single braid 12 is preferably about one-quarter the circumference of the braid.

Figure 4:
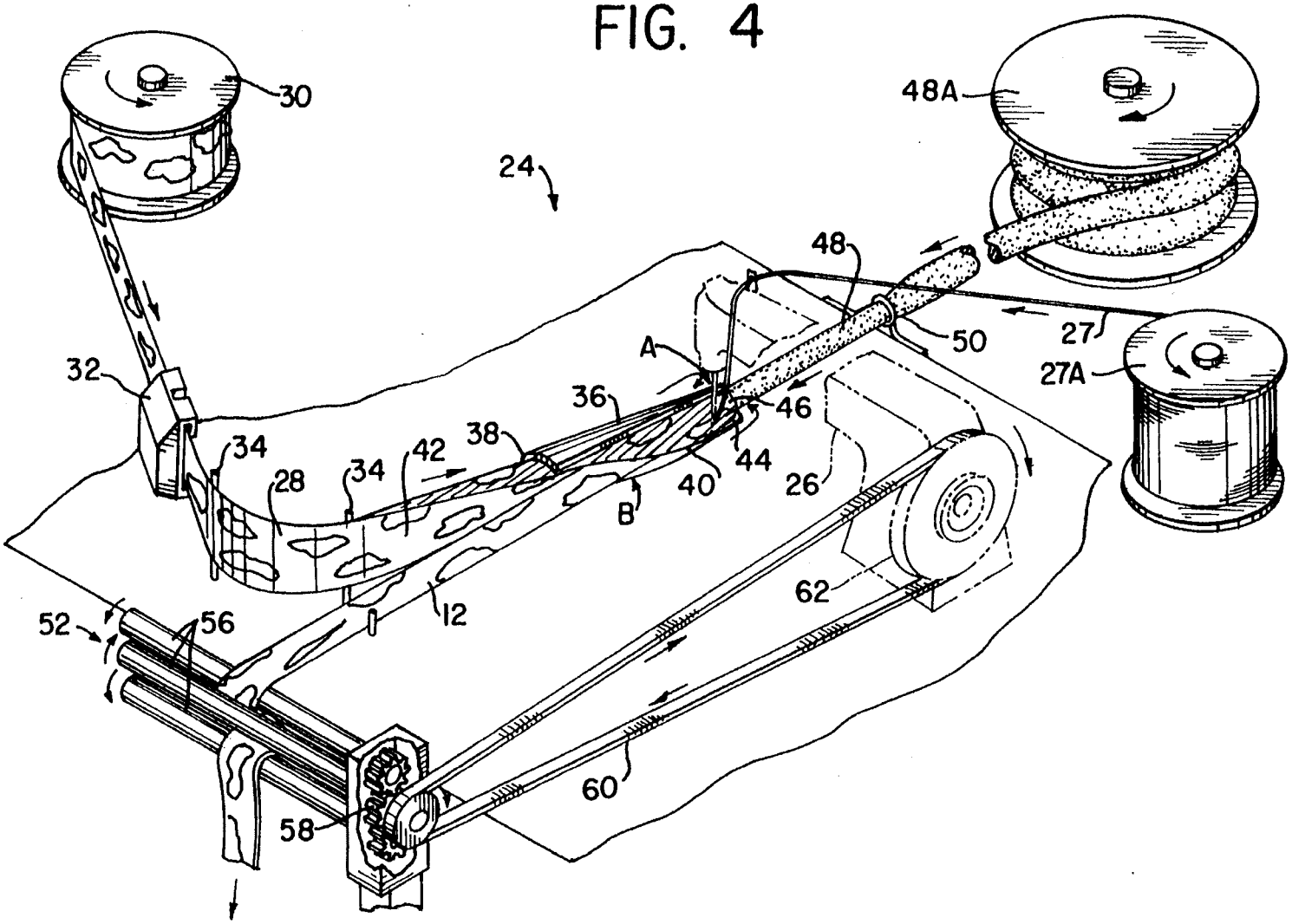
FIG. 4 is a perspective view of an apparatus for producing a tubular braid rug according to the invention.

To produce the tubular braid 12 at a high rate and low cost, the entire sewing and filling process is performed automatically and simultaneously on a single apparatus 24, a preferred embodiment of which is shown in FIG. 4. This apparatus 24 is preferably mounted on a sewing machine 26, as described below.

Initially, the covering fabric strip 28 for the braid 12 is fed from a fabric source 30, such as the roll shown, in a flat configuration. It passes through a brake 32 that maintains tension on the strip 28 and prevents free-wheeling of the fabric source 30 from jamming the apparatus. The strip 28 travels around guides 34 to be fed into the concave surface of a curved plate 36. Specifically, the plate 36 has a half-cone shape that has a shallow curve at the point of entry 38 of the fabric strip 28. The plate 36 then tapers down to a sharp curve (i.e., smaller radius of curvature) to cause the strip 28 to become folded along its longitudinal axis, i.e., the lateral edges 40 are brought together. The strip 28 is folded by the curved plate with the design side 42 of the fabric strip 28 facing inwardly. This will facilitate hiding the seam 44 later in the production process, as discussed below.

As the lateral edges 40 of the fabric strip 28 are brought together, they are sewn with any standard stitch using the sewing machine 26. Thread 27 from a roll 27A is supplied to the sewing machine 26 in the conventional manner. Immediately after sewing, the fabric strip, now formed into a tube 46 is inverted or turned inside-out so that the design side 42 of the fabric is now facing outward. Simultaneously, a non-woven filler 48 from a roll 48A, such as a foam material, is fed to the inversion point A. The filler 48 is maintained under tensile pressure by a brake 50 and the puller 52, described below. The tensile pressure causes a radial compression of the filler 48, making it easier to insert the filler 48 into the tube of fabric 46. In essence, the tube 46 is inverted onto the filler 48 as it is fed, eliminating the need for later sliding filler axially into the tube, which would encounter great friction.

Figure 6:
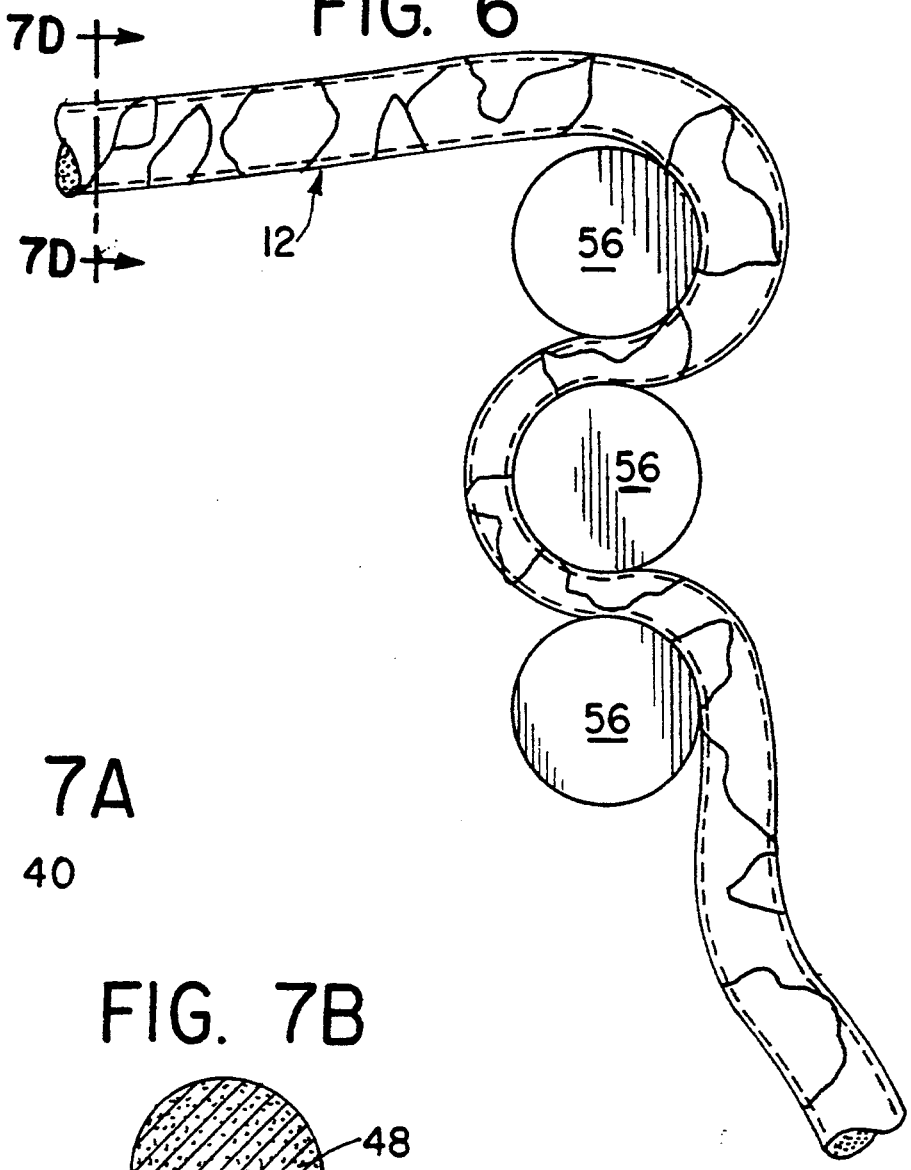
FIG. 6 is a detail view of a roller mechanism within an apparatus for producing a tubular braid according to the invention.
Figure 7A:
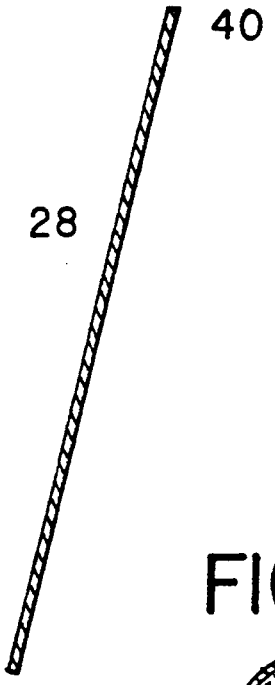
FIGS. 7A–7D are cross-sections taken along the lines 7A—7A, 7B—7B, 7C—7C, and 7D—TD, respectively in FIGS. 5 and 6.
Figure 7B:
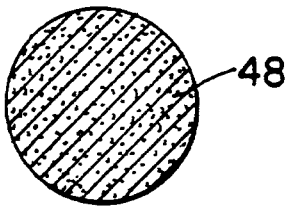
Figure 7C:
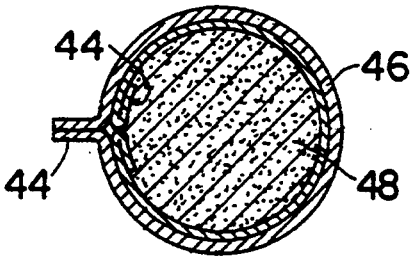
Figure 7D:
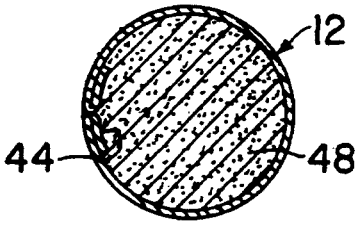

The now inverted braid 12 is then pulled through the folded unsewn fabric strip 28 (at point B) and out to the exit area of the machine. The braid 12 is preferably pulled by a three-tier puller 52, which essentially comprises three rollers 56 (FIG. 6) with gaps between them less than the nominal diameter of the completed braid 12. The braid 12 becomes pinched between the rollers 56 and is frictionally fed through them. The three rollers 56 are preferably connected by a gear assembly 58 that is connected by a belt 60 to the handwheel 62 of the sewing machine 26. This allows the variable speed of the sewing machine 26 to correspondingly vary the speed of the puller 52. The gears 58 may also be mechanically connected to the handwheel 62 by other connections, such as chains synchronized motors, etc. The ratio of the diameter of the wheel on the puller 52 to the diameter of the handwheel 62 must be precisely determined to ensure the proper speed and tension of the puller 52. The puller 52 should only pull the braid 12 as fast as is necessary. Other speeds would ruin the balance between folding, sewing and inverting that occurs in the relatively small sewing area. After the braid 12 has left the machine 24, the filler 48 may expand under its own resiliency to fill the tube completely.

After a sufficient length of braid 12 has been formed, the braid 12 may be coiled and sewn into the finished rug 10. This entails feeding the finished braid 12 into another sewing machine (not shown) that will provide the braid-to-braid cross-stitches 14 seen in FIGS. 1–3. This second sewing machine includes a bi-level foot 70 (FIGS. 8 and 9) that holds two adjacent sections of braid 72, 74 together as they are sewn. The braid 72, 74 is fed into the machine and simultaneously coiled to form the final rug shape. At the point where the new loose braid 72 meets the remainder of the already-sewn rug 74, the special foot 70 holds the loose braid 72 in abutment with the completed sections.

Figure 8:
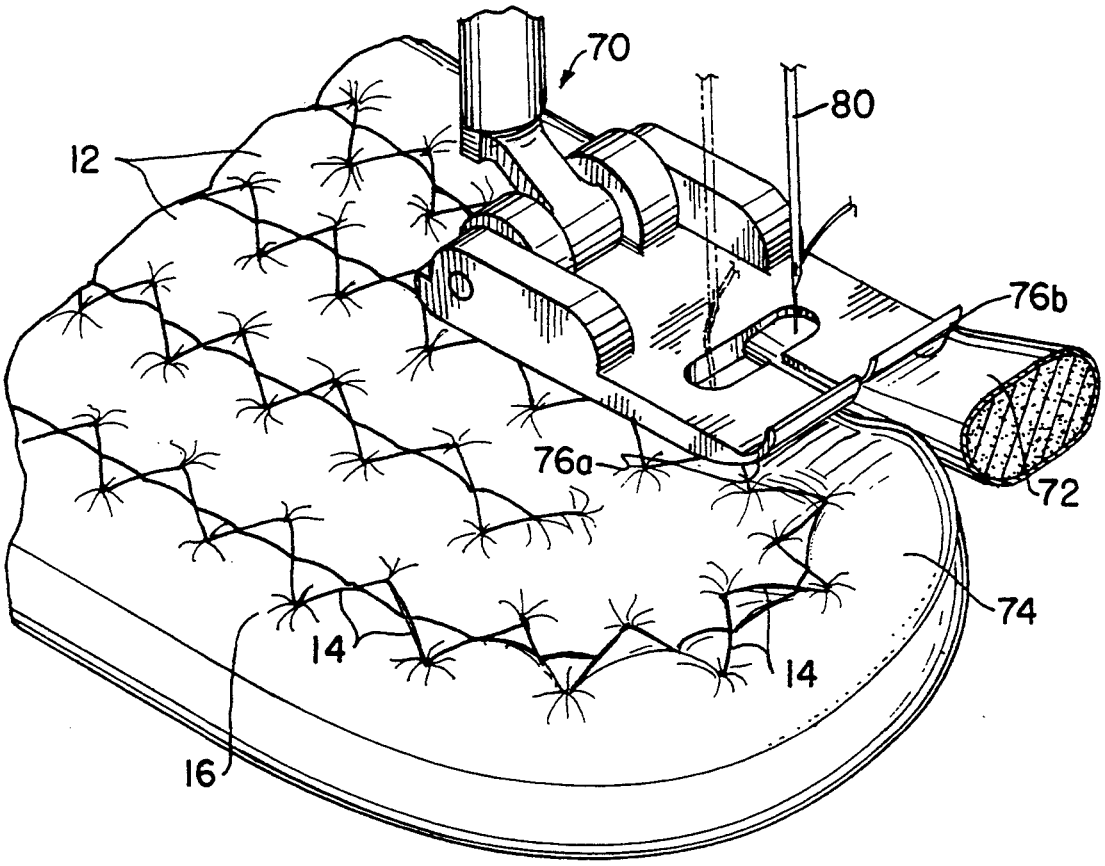
FIG. 8 is a perspective view of a sewing foot according to the invention used to attach adjacent sections of tubular braid to form a rug as in FIG. 1.
Figure 9:
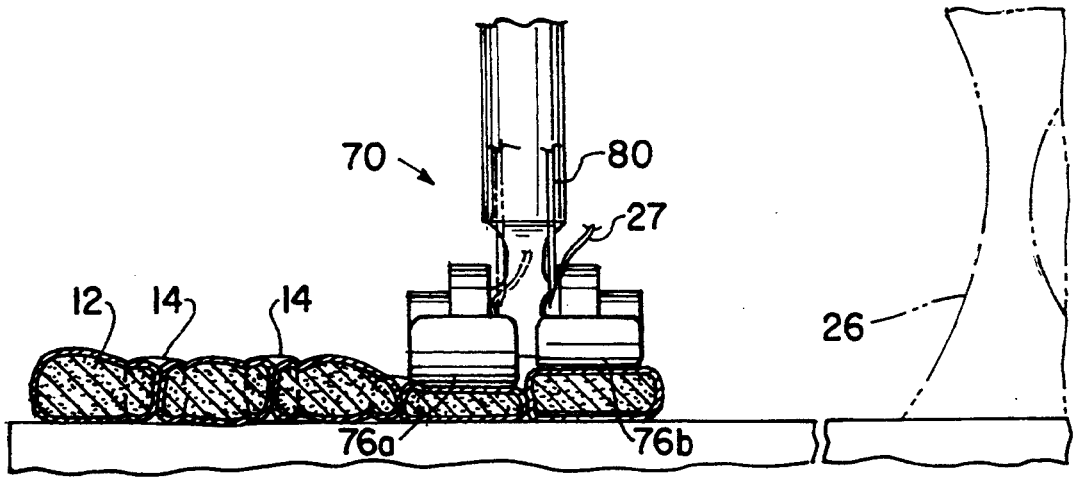
FIG. 9 is a front view of the sewing foot of FIG. 8.

The preferred sewing foot 70 used to form the finished rug from the tubular braid 72, 74 is shown in FIGS. 8 and 9. The bottom surface **76*a*, 76*b* of the foot is split along the direction of travel of the braid into two levels 76*a*, 76*b*. This causes uneven pressure to be applied to two adjacent tubular braids 72, 74 that are to be sewn with a cross stitch. Preferably, the portion of the foot 76*a* pressing on the portion of the rug 74 that is already finished is lower than the other portion 76*b*. The added pressure causes the rug to be pulled evenly, while the other portion 76*b* exerts less pressure and allows the loose tubular braid 72 to easily feed at a rate comparable to the rug 74**.

A needle 80 of the second sewing machine then penetrates the adjacent braids 72, 74 at the appropriate positions to form the upper and lower cross stitches 14.

It is preferable that the second sewing machine include a worktable large enough to accommodate the rug as it turns to allow the incoming loose braid to be coiled around its increasing circumference. Once the rug has been coiled to the desired size, the remaining loose braid is cut off (not shown) and the end of the braid is sewn closed to the adjacent section of braid. This prevents any unraveling of the rug or loosening of the filler within the braid.

Figure 5:
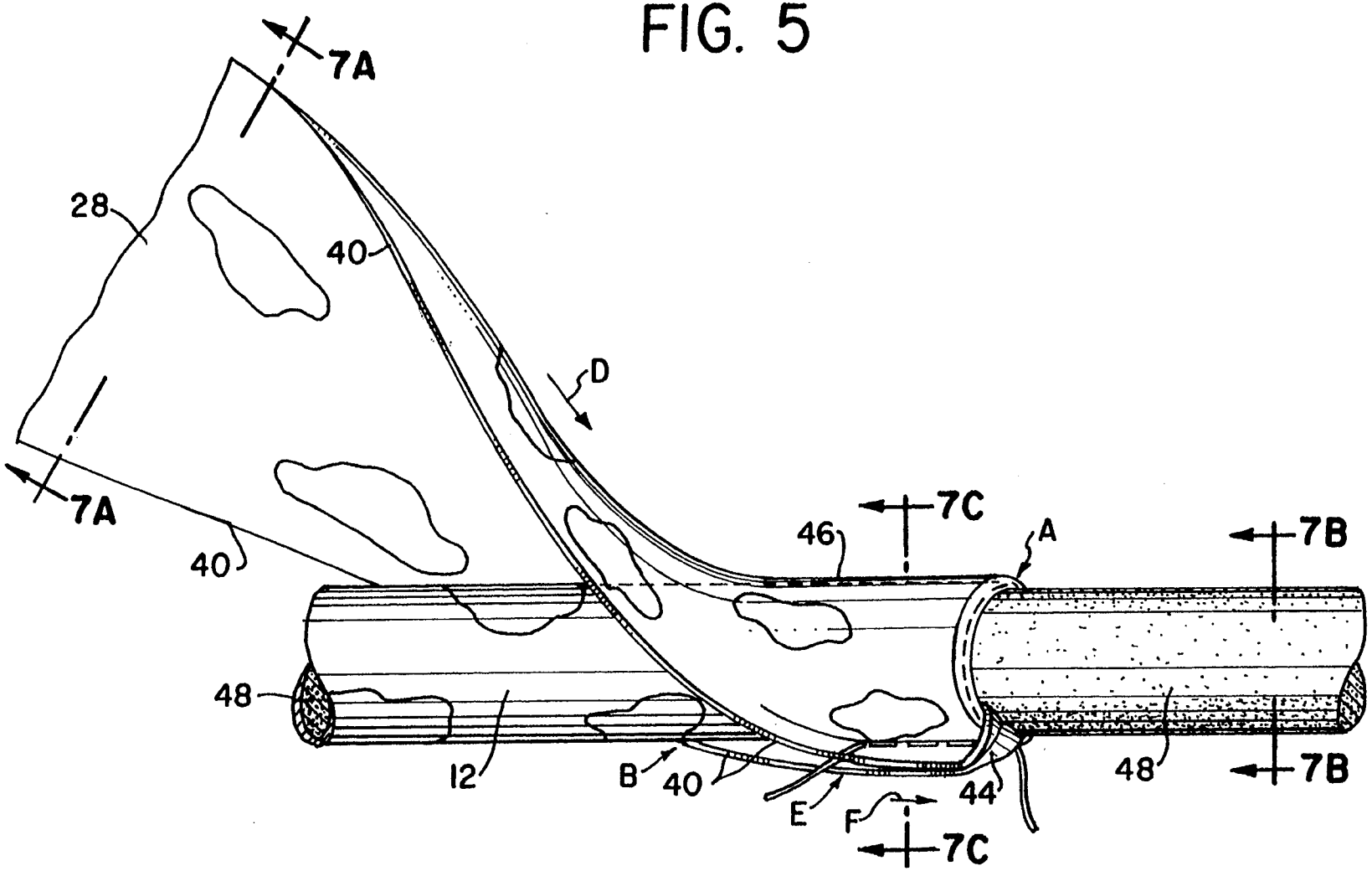
FIG. 5 is a detail perspective view of a tubular braid during intermediate steps of sewing.

FIG. 5 provides a detail view of the sewing area C of the first sewing machine 24 and the processes that form the finished braid 12, which all occur almost simultaneously. Various cross sections are shown of FIGS. 5 and 6, in FIGS. 7A–7D For purposes of clarity, only the fabric strip 28 and the filler 48 used to form the braid 12 are shown in FIG. 5; the devices used to manipulate these parts have been omitted to provide a clear understanding of the sewing process.

The flat strip of fabric 28 enters the sewing area C from a front direction towards the rear of the machine (as indicated by arrow D) and is folded over onto itself before reaching the sewing point E. The strip 28 is folded so that the design 42 initially faces inward. After the two lateral edges 40 of the strip 28 are brought together, they are stitched (at E) or attached in any other known fashion (such as fasteners, staples, etc.). Just downstream of the point at which the edges are sewn, the strip in the form of the tube is inverted and fed rearwardly (i.e., toward the rear of the apparatus (at F).

The puller pulls the finished tubular braid 12 from the sewing area C toward the front of the apparatus. Thus, as the sewing machine feeds the sewn tube rearwardly, the puller causes the tube to continuously invert itself at the inversion point A and simultaneously roll over the filler 48, which is fed to the sewing area C from the rear of the apparatus. The seam 44 is shown as being spread apart as it is inverted to the inside of the braid 12. This spreading is irrelevant, (i.e., the entire seam 44 could be folded one way or the other, since the seam 44 will be within the finished braid 12 and will not be seen or felt by the consumer). However, it is necessary to have the puller synchronized with the sewing machine. If the puller were to pull too fast, the inversion point A would move toward the sewing point E, eventually pulling the fabric 28 away from the sewing point E altogether.

It should be clear that the apparatus 24 and its sewing operation will have to be manually started. Before the machine 24 is activated, there will be no finished braid 12 on which the puller 52 can pull. Therefore, it is necessary for a small amount of tube to be sewn (or at least held together) and inverted while the finished braid 12 is manually pulled from the sewing area C until a sufficient length is available for loading into the puller 52.

The preferred three-tier puller 52 may be substituted with any mechanism that will maintain a constant pull on the braid. The preferred puller 52 provides consistent movement through its dual friction action and linkage to the sewing machine 24. The puller 52 applies friction to the finished braid 12 both by pinching the braid 12 at the two gaps between rollers 56 and also by wrapping the braid 12 around the outer surfaces of the rollers 56, which is known to multiply the applied frictional force. Also, the puller exerts sufficient tension on the filler material 48 to cause a decrease in its diameter so the filler will easily fit within the tube. After the filled tube passes through the puller, the filler resumes its full shape thereby completely filling the interior of the finished braid.

Thus, it can be seen that a coiled braid rug 10 having flat top and bottom surfaces 20, 22 can be achieved with the tubular braid 12 and sewing foot of the present invention. In addition, the braid 12 can be quickly and economically produced with the apparatus described above.

While the embodiments shown and described are fully capable of achieving the objects of the invention, it is to be understood that these embodiments are shown and described solely for the purpose of illustration and not for limitation.

What is claimed is:

1. A method for forming a tubular braid for a rug, comprising the steps of:

feeding a strip of fabric to a sewing area of a sewing machine from a first direction, said fabric having two surfaces and two lateral edges;

folding said fabric as said fabric is fed to said sewing area such that said lateral edges are brought together and one of said surfaces is on an exterior of the folded fabric;

connecting said lateral edges to each other with said sewing machine;

inverting said fabric;

feeding a filler material to an interior of the inverted fabric such that said fabric surrounds said filler material;

braking said filler material prior to being fed into the interior of the inverted fabric; and pulling the inverted fabric with the filler material through the interior of the folded, unbonded fabric toward the first direction whereby the filler material is maintained under tensile pressure by the braking and the pulling to cause a radial compression of the filler material.

2. A method as in claim 1, further comprising the step of tensioning said filler material such that its diameter is decreased.

3. A method as in claim 1, wherein said step of pulling comprises pinching said inverted fabric through powered pinch rollers.

4. An apparatus for forming a tubular braid for a rug, said tubular braid including a fabric covering formed of a fabric strip and a filler material, the fabric strip having lateral edges, said apparatus mounted on a sewing machine having a sewing area, said apparatus comprising:

means for feeding the fabric strip from a first direction to said sewing area:

means for folding the fabric strip such that said lateral edges are in abutting relationship at said sewing area to be sewn together by said sewing machine to form the fabric covering;

means for feeding the filler material to said sewing area from a second direction generally opposite said first direction, said filler material being fed into the fabric covering;

means for braking said filler material prior to being fed into the fabric covering;

means for pulling the sewn fabric covering with the filler material toward said first direction and away from said sewing area whereby said fabric covering is inverted onto said filler material and the filler material is maintained under tensile pressure by the means for braking and the means for pulling to cause a radial compression of the filler material.

5. An apparatus as in claim 4 wherein said means for pulling comprises at least two pinch rollers between which said sewn fabric covering with the filler material travel.

6. An apparatus as in claim 5 wherein said means for pulling comprises three pinch rollers, said sewn fabric traveling through said rollers in an S-shaped path.

7. An apparatus as in claim 4 wherein said means for folding is comprised of a sheet material having a curve and two ends, said curve having a smaller radius at one end than the other.

8. A method of forming a rug from a tubular braid having a circumference, comprising the steps of:

arranging said braid with at least two sections of said braid adjacent each other at a tangential point;

forming stitches in said adjacent sections, said stitches entering and leaving said braid at stitch points away from tangential point;

compressing said braid such that said braid has a substantially rectangular cross section;

feeding a further section of said braid into juxtaposition with a section that has already been stitched; and wherein said step of compressing comprises applying greater pressure to said stitched section than to said further section.

9. A method as in claim 8 wherein said stitch points are about one-eighth of said circumference from said tangential point.

10. A method as in claim 9 wherein said stitches are formed as cross stitches.

11. A method as in claim 8 further comprising the step of compressing said braid such that said braid has a substantially rectangular cross section.

12. A method as in claim 8 wherein said step of compressing comprises applying greater pressure to one of said adjacent sections than to the other of said sections.

* * * * *